US010428293B2

(12) United States Patent
Kotnis et al.

(10) Patent No.: US 10,428,293 B2
(45) **Date of Patent: *Oct. 1, 2019**

(54) ENHANCED EXTREME PRESSURE LUBRICANT FORMULATIONS

(71) Applicant: Dow Global Technologies LLC, Midland, MI (US)

(72) Inventors: Ashish Kotnis, Auburn Hills, MI (US); Martin R. Greaves, Horgen (CH); Govindlal Khemchandani, Clute, TX (US)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/553,666

(22) PCT Filed: Feb. 22, 2016

(86) PCT No.: PCT/US2016/018913

§ 371 (c)(1),
(2) Date: Aug. 25, 2017

(87) PCT Pub. No.: WO2016/137880

PCT Pub. Date: Sep. 1, 2016

(65) Prior Publication Data

US 2018/0030370 A1 Feb. 1, 2018

Related U.S. Application Data

(60) Provisional application No. 62/120,918, filed on Feb. 26, 2015.

(51) Int. Cl.

| | |
|---|---|
| ***C10M 169/04*** | (2006.01) |
| ***C10M 141/08*** | (2006.01) |
| ***C10M 105/00*** | (2006.01) |
| ***C10M 135/04*** | (2006.01) |
| ***C10M 145/04*** | (2006.01) |
| ***C10M 161/00*** | (2006.01) |

(52) U.S. Cl.

CPC ..... *C10M 169/044* (2013.01); *C10M 105/00* (2013.01); *C10M 135/04* (2013.01); *C10M 141/08* (2013.01); *C10M 145/04* (2013.01); *C10M 161/00* (2013.01); *C10M 169/04* (2013.01); *C10M 2203/003* (2013.01); *C10M 2203/1006* (2013.01); *C10M 2203/1025* (2013.01); *C10M 2205/0285* (2013.01); *C10M 2209/04* (2013.01); *C10M 2209/106* (2013.01); *C10M 2209/107* (2013.01); *C10M 2209/1065* (2013.01); *C10M 2209/1075* (2013.01); *C10M 2219/022* (2013.01); *C10M 2223/047* (2013.01); *C10N 2230/06* (2013.01); *C10N 2240/04* (2013.01)

(58) Field of Classification Search

CPC ..... C10M 145/34; C10M 2209/103
See application file for complete search history.

(56) References Cited

U.S. PATENT DOCUMENTS

| | | | | |
|---|---|---|---|---|
| 2,520,733 | A | 8/1950 | Morris et al. | |
| 3,966,625 | A | 6/1976 | Tanizaki et al. | |
| 5,135,670 | A | 8/1992 | Johnson et al. | |
| 5,700,764 | A | 12/1997 | Walters et al. | |
| 8,969,271 | B2 * | 3/2015 | Greaves | C10M 107/34 508/579 |
| 2005/0256014 | A1 | 11/2005 | Sherman et al. | |
| 2006/0223720 | A1 * | 10/2006 | Sullivan | C10M 141/10 508/433 |
| 2006/0240998 | A1 | 10/2006 | Sullivan et al. | |
| 2007/0004606 | A1 | 1/2007 | Da Costa et al. | |
| 2007/0078066 | A1 | 4/2007 | Milner et al. | |
| 2008/0280791 | A1 * | 11/2008 | Hewette | C10M 167/00 508/149 |
| 2009/0143264 | A1 | 6/2009 | Harrison et al. | |
| 2010/0087349 | A1 | 4/2010 | Lee et al. | |
| 2010/0105589 | A1 | 4/2010 | Lee et al. | |
| 2011/0039741 | A1 | 2/2011 | Thoen et al. | |
| 2013/0244917 | A1 * | 9/2013 | Obrecht | C10M 169/04 508/444 |
| 2013/0288939 | A1 | 10/2013 | Greaves et al. | |
| 2014/0303053 | A1 * | 10/2014 | Greaves | C10M 169/04 508/282 |

(Continued)

FOREIGN PATENT DOCUMENTS

| | | |
|---|---|---|
| EP | 0531000 | 3/1993 |
| EP | 0460317 | 10/1993 |

(Continued)

OTHER PUBLICATIONS

International Preliminary Report on Patentability for related PCT Application PCT/US2016/018913, dated Sep. 8, 2017 (7 pgs).
International Search Report and Written Opinion for related PCT Application PCT/US2016/018913, dated May 31, 2016 (11 pgs).
"Polyalkylene Glycol Synthetic Turbine Fluid Technology" Lubricants and Fuel Additives; Dow's Synthetic Gas Turbine Fluid—The First PAG to meet GEK 32568 (h), (Aug. 30, 2009) (4 pgs).
Dr. Govind Khemchandani; The Dow chemical Company,"Characteristics of New Oil Soluble Polyalkylene Glycols" (Feb. 9, 2011) (22 pgs).

(Continued)

*Primary Examiner* — Ellen M McAvoy
(74) *Attorney, Agent, or Firm* — Brooks, Cameron & Huebsch, PLLC

(57) ABSTRACT

A lubricant formulation contains: (a) at least 50 weight-percent hydrocarbon base oil; (b) five to 50 weight-percent of an oil soluble polyalkylene glycol selected from monol, diol and triol initiated 1,2-butylene oxide homopolymer and monol initiated copolymers of 1,2-butylene oxide and propylene oxide; and (c) 0.1 to five weight-percent or less of a sulfurized olefin; where weight-percent is based on total lubricant formulation weight.

11 Claims, No Drawings

(56) References Cited

U.S. PATENT DOCUMENTS

| | | | | |
|---|---|---|---|---|
| 2015/0038664 | A1* | 2/2015 | Hayashi | C08G 65/10 528/29 |
| 2015/0275124 | A1 | 10/2015 | Greaves | |
| 2016/0068780 | A1 | 3/2016 | Greaves et al. | |
| 2016/0215091 | A1* | 7/2016 | Masy | C08G 65/12 |
| 2017/0211009 | A1* | 7/2017 | Khelidj | C10M 145/32 |
| 2017/0218296 | A1* | 8/2017 | Khelidj | C10M 145/34 |

FOREIGN PATENT DOCUMENTS

| | | |
|---|---|---|
| EP | 1624043 | 5/2013 |
| JP | S54-159411 | 12/1979 |
| JP | H0-2269198 | 11/1990 |
| JP | 2009161685 | 7/2009 |
| WO | 2013003405 | 1/2013 |

OTHER PUBLICATIONS

Zhong, et al., "Lubricating Greases and Additives for Automobiles"; Chemical Industry Press, p. 19 (1 pg) (Jul. 31, 2006) (English Machine Translation).

* cited by examiner

ENHANCED EXTREME PRESSURE LUBRICANT FORMULATIONS

This application is a National Stage Application under 35 U.S.C. § 371 of International Application Number PCT/US2016/018913, filed Feb. 22, 2016 and published as WO 2016/137880 on Sep. 1, 2016, which claims the benefit of U.S. Provisional Application 62/120,918, filed Feb. 26, 2015, the entire contents of which are incorporated herein by reference in its entirety.

BACKGROUND OF THE INVENTION

Field of the Invention

The present invention relates to gear lubricant formulations.

Introduction

In industrial and automotive gears and in automotive engines, lubricants are used to minimize wear and friction between contacting surfaces. In some contact zones, such as meshing gear teeth, very high contact pressures are experienced. In some cases the heat generated from high friction can cause welding of the contacting surfaces. In order to protect equipment on high contact pressure applications lubricants are often formulated with sulfur-containing extreme pressure (EP) additives. Sulfur-containing EP additives react with a metal surface in the high temperature contact zone and form a thin tribo film of iron sulfide or other organometallic complexes that are rich in iron and sulfur, which rapidly form and deplete, protecting the metal surface from degrading. The sulfur content resulting from the EP additives in industrial lubricants can be as high as 15,000 weight parts per million (ppm) and in automotive gear oil lubricants the sulfur content can be as high as 25,000 ppm.

Unfortunately, the presence of sulfur in lubricant formulations can present challenges. For instance, sulfur containing EP additives can degrade to form compounds that lead to varnish and sludge in high temperature applications, thereby reducing the life of the equipment it is lubricating. Sulfur is also corrosive towards yellow metals (for example, copper alloys) so lubricant formulations used in yellow metal environments require additional corrosion inhibitor and sulfur scavengers to meet corrosion resistant requirements.

It is desirable to identify a way to reduce the amount of sulfur EP additive in a lubricant formulation without reducing the extreme pressure performance of the lubricant formulation.

BRIEF SUMMARY OF THE INVENTION

The present invention provides a solution to the problem of finding a way to reduce the amount of sulfur extreme pressure (EP) additive in a lubricant formulation without reducing the extreme pressure performance of the lubricant formulation.

Surprisingly, the present invention is a result of unexpectedly discovering a synergistic effect between oil soluble polyalkylene glycol (OSP) and sulfurized olefin extreme pressure (EP) additives that increase the efficacy of the extreme pressure additive in a hydrocarbon base oil lubricant. As a result, less sulfurized olefin EP additive can be used and, provided the OSP is present, the EP properties are not diminished. The use of a combination of an OSP and sulfurized olefin allows less sulfur to be present in a hydrocarbon base oil lubricant while still achieving the same or better EP performance as is achieved in the lubricant without an OSP polymer and with higher levels of sulfurized olefin.

In a first aspect, the present invention is a lubricant formulation comprising: (a) at least 50 weight-percent of a hydrocarbon base oil; (b) five weight-percent or more and less than 50 weight-percent of an oil soluble polyalkylene glycol selected from a group consisting of monol, diol and triol initiated 1,2-butylene oxide homopolymers and monol initiated copolymers of 1,2-butylene oxide and propylene oxide; and (c) 0.1 weight-percent or more and five weight-percent or less of a sulfurized olefin in one embodiment and three weight-percent or less of sulfurized olefin in another embodiment; wherein the weight-percent of the above components is based on total lubricant formulation weight.

In a second aspect, the present invention is a method of increasing the extreme pressure performance of a lubricant formulation containing hydrocarbon base oil and sulfurized olefin, the method comprising adding to the lubricant formulation an oil soluble polyalkylene glycol selected from a group consisting of monol, diol and triol initiated 1,2-butylene oxide homopolymers and monol initiated random copolymers of 1,2-butylene oxide and propylene oxide so as to obtain the lubricant formulation of the first aspect.

The formulation and method of the present invention is useful as a lubricant.

The oil soluble polyalkylene glycols of the present invention can be designed from oxides other than 1,2 butylene oxide. For example it is possible to design oil soluble polyalkylene glycols from other higher oxides such as hexene oxide, octene oxide, dodecene oxide or styrene oxide such that homo-polymers are produced by reacting the oxides with an initiator such as an alcohol. Alternatively, copolymers can be produced by reacting mixtures of the copolymers with an initiator. Alternatively, mixtures of a higher oxide and 1,2 propylene oxide or 1,2 butylene oxide can be used to prepare copolymers. The above alternative types of oil soluble polyalkylene glycols are expected to provide a similar technical effect as the copolymers of propylene oxide and butylene oxide or homo-polymers of butylene oxide that are described herein in the present invention.

DETAILED DESCRIPTION OF THE INVENTION

"And/or" means "and, or alternatively". All ranges include endpoints unless otherwise stated. Weight-percent (wt %) is relative to total lubricant formulation weight unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Determine viscosity index for a lubricant composition according to ASTM D2270. Determine pour point temperature according to ASTM D97.

Determine molecular weight for non-capped oil soluble polyalkylene glycol polymers in grams per mole (g/mol) from the OH (hydroxyl) number according to ASTM D4274.

Determine the molecular weight for capped oil soluble polyalkylene glycol polymers by adding the weight of the capping agent minus one. For example, the molecular weight of a methyl capping group is 15, but since the methyl group is chemically replacing a hydrogen on the non-capped polyalkylene glycol the resulting molecular weight of the polyalkylene glycol is increased by 15 from the capping group but reduced by one from loss of the hydrogen that is replaced.

Characterize extreme pressure performance using a pin and vee-block test according to ASTM D3233. The test is the "Falex EP test". The test apparatus is available from Falex Corporation and consists of a 0.25 inch (6.35 millimeter) diameter steel rod (journal) that rotates at 290+/−10 revolutions per minute against two 0.5 inch (12.7 millimeter) diameter vee blocks. A four line contact region is established as load is applied through a mechanical sprint-type gage by a ratchet wheel and an eccentric arm. The test determines a load-fail value that relates to the load-carrying properties of the test fluid. The Falex load gage applies from 200 to 3000 pounds (91-1361 kilograms) direct load (4500 pounds (2041 kilograms) reference load). Conduct the test against test method B until a rise in friction coefficients or a drop in load or a failure of the shear pin is observed. A typical automotive gear oil formulation that contains extreme pressure additives will have a load carrying capacity of 2500 pounds (1135 kilograms) while a typical engine oil formulation that does not contain sulfur based extreme pressure additives has a load carrying capacity of 1300 pounds (590 kilograms). An "increase" and an "improvement" in extreme pressure performance, and an "increased", "improved", and/or "higher" extreme pressure performance, each corresponds to an increase in load carrying capacity.

The lubricant formulation comprises a natural or synthetic hydrocarbon base oil. Hydrocarbon base oils are classified by the American Petroleum Institute (API) into five classes: Group I, Group II, Group III, Group IV and Group V. Group I-III base oils are considered natural hydrocarbon base oils, Group IV base oils are synthetic hydrocarbon base oils that are polyalphaolefins and Group V base oils are considered other synthetic base oils. Group I base oils are composed of fractionally distilled petroleum which is further refined with solvent extraction processes to improve properties such as oxidation resistance and to remove wax. The viscosity index of Group I base oils is between 80 and 120. Group I base oils have a sulfur content of more than 0.03 weight percent (wt %). Group II base oils are composed of fractionally distilled petroleum that has been hydrocracked to further refine and purify it. Group II base oils also have a viscosity index between 80 and 120, but a sulfur content of less than 0.03 wt %. Group III base oils have similar characteristics to Group II base oils but have a viscosity index above 120 with a sulfur content less than 0.03 wt %. Group II base oils are highly hydro-processed oils and Group II base oils are highly hydro-cracked oils. Group III base oils have a higher viscosity index than Group II base oils, and are prepared by either further hydro-cracking of Group II base oils, or by hydro-cracking of hydro-isomerized slack wax, which is a byproduct of the dewaxing process used for many of the oils in general. Group IV base oils are synthetic hydrocarbon oils, which are also referred to as polyalphaolefins (PAOs). Group V base oils are other synthetic base oils such as synthetic esters, polyalkylene glycols, polyisobutylenes, and phosphate esters. The hydrocarbon base oil for use in the present invention can be selected from any of Group I, II, III or IV base oils or any combination selected thereof. In one desirable embodiment, the hydrocarbon base oil is selected from Group III and IV base oils.

The hydrocarbon base oil is present at a concentration of at least 50 weight-percent (wt %), preferably more than 50 wt %, more preferably 60 wt % or more and can be 65 wt % or more, 70 wt % or more, 75 wt % or more, 80 wt % or more, 85 wt % or more, even 90 wt % or more relative to the total weight of the lubricant formulation. At the same time, the hydrocarbon base oil is present at a concentration of less than 100 wt % of the total weight of the lubricant formulation to account for the presence of OSP and sulfurized olefin and any additional additives that are present.

The inventive lubricant formulation also comprises an oil soluble polyalkylene glycol (OSP). OSPs are miscible, preferably soluble, in hydrocarbon base oils as is evident by their ability to form a clear mixture as evaluated optically with an unaided eye. Polyalkylene glycols (PAGs) that comprise polymerized alkylene oxides selected only from ethylene oxide and propylene oxide are not considered OSPs. Desirably, the lubricant formulation of the present invention is free of PAGs that comprise polymerized alkylene oxides selected only from ethylene oxide and propylene oxide and can be free of PAGs that are not OSPs. PAGs generally comprise an initiator component, a polyalkylene oxide component and an end group at the end of each polyalkylene oxide chain opposite from the initiator component.

The OSP of the present lubricant formulation is selected from a group consisting of monol, diol and triol initiated 1,2-butylene oxide homopolymers and monol initiated copolymers of 1,2-butylene oxide and 1,2-propylene oxide (herein referred to simply as "propylene oxide"). Preferably the 1,2-butylene oxide homopolymer is monol or diol initiated, and most preferably monol initiated. Monols, diols and triols are alcohols having from one to 18 carbon atoms, preferably having six or more, more preferably eight or more and still more preferably ten or more carbon atoms while at the same time preferably having 16 or fewer, more preferably 14 or fewer and most preferably 12 or fewer carbon atoms. Monols are alcohols with a single hydroxyl group. Diols are alcohols with two hydroxyl groups. Triols are alcohols with three hydroxyl groups. Examples of desirable monol initiators include 1-dodecanol, butanol, 2-ethylhexanol, n-octanol, decanol, and oleyl alcohol. Examples of suitable diols include ethylene glycol, 1,2-propylene glycol, 1,3-propylene glycol, and 1,4-butanediol. Examples of suitable triols include glycerol and timethylolpropane.

The 1,2-butylene oxide homopolymer is initiated with a monol, diol or triol and contains polymerized 1,2-butylene oxide as its only polyalkylene oxide component. The copolymer of 1,2-butylene oxide and propylene oxide is imitated with a monol and contains copolymerized 1,2-butylene oxide and propylene oxide as its only polyalkylene oxide component. The copolymerized 1,2-butylene oxide and propylene oxide can be block or randomly copolymerized, but is preferably randomly polymerized to form a random copolymer. The OSP that is a copolymer of 1,2-butylene oxide and propylene oxide desirably is made using 50 wt % or more 1,2-butylene oxide relative to total weight of 1,2-butylene oxide and propylene oxide.

The OSP can be capped or remain uncapped. If the OSP remains uncapped, it terminates with a hydroxyl group (—OH) on the end opposite from the alcohol initiator for each alkylene oxide polymer chain extending from the alcohol initiator. Desirably, the OSP remains uncapped. It can, however, be capped with groups such as alkyl, aryl and alkylaryl groups.

One example of a desirable OSP is an uncapped dodecanol-initiated random copolymer of 1,2-butylene oxide and propylene oxide. Desirably the weight ratio of 1,2-butylene oxide and propylene oxide is approximately 50:50. Alternatively, or additionally, the copolymer has a molecular weight of 300 grams per mole (g/mol) or more, preferably 400 g/mol or more, more preferably 450 g/mol or more and most preferably 500 g/mol or more while at the same time has a molecular weight of 700 g/mol or less, preferably 600 g/mole or less, more preferably 550 g/mol or less and most preferably 500 g/mol or less.

The OSP is present at a concentration of 5 wt % or more, preferably 10 wt % or more and can be present at a concentration of 15 wt % or more, 20 wt % or more, 25 wt % or more, even 30 wt % or more. At the same time, the OSP is typically present at a concentration of 50 wt % or less. Wt % is based on total lubricant formulation weight.

The lubricant formulation of the present invention further comprises a sulfurized olefin. The sulfurized olefin serves as an extreme pressure additive and is desirably selected from those sulfurized olefins known to serve as extreme pressure additives in lubricant formulations. Sulfurized olefins are generally prepared by initially reacting sulfur and an alkali-metal sulfide hydrate such as sodium sulfide nonahydrate in a high pressure reactor to form a sulfur-sulfide as taught, for example, in U.S. Pat. No. 5,135,670, which incorporated herein by reference. An olefin is then added and the mixture stirred and heated. The sulfurized olefin is then recovered, washed with water and dried. The olefin in the sulfurized olefin is desirably selected from olefins having from 2 to 32 carbons atoms such as, for example, butylenes, pentenes, propenes. Desirably, the olefin is isobutylene. The mole ratio between sulfur plus sulfide and olefin generally ranges from 5:1 to 1:1.

The concentration of sulfurized olefin in the lubricant formulation is desirably 0.1 wt % or more, preferably 0.5 wt % or more, more preferably one wt % or more, and can be 1.5 wt % or more. At the same time, the concentration of sulfurized olefin in the lubricant formulation is typically five wt % or less and can be 3 wt % or less, 2.5 wt % or less, two wt % or less and even 1.5 wt % or less.

Particularly desirable formulations of the present invention comprise a combination of hydrocarbon oil selected from Group II, III and IV base oils, a dodecanol-initiated random copolymer of 1,2-butylene oxide and propylene oxide, and sulfurized isobutylene.

The lubricant formulation can contain components in addition to the hydrocarbon base oil, OSP and sulfurized olefin. For example, the lubricant formulation can contain additional additives commonly used in lubricant formulations. Examples of suitable additional components include any one or combination of more than one selected from a group consisting of antioxidants, corrosion inhibitors, anti-wear additive, foam control agents, yellow metal passivators, dispersants, detergents, friction reducing agents, pour point depressants and dyes. Additional additives are desirably soluble in the hydrocarbon base oil.

The lubricant formulation of the present invention surprisingly achieves increased extreme pressure performance relative to a similar formulation without either the sulfurized olefin or without the OSP. The OSP and sulfurized olefin unexpectedly operate synergistically to increase extreme pressure performance of the lubricant formulation.

Accordingly, the present invention further includes a method for increasing the extreme pressure performance of a lubricant formulation containing hydrocarbon base oil and sulfurized olefin, the method comprising adding to the lubricant formulation an OSP selected from a group consisting of alcohol initiated homopolymers of 1,2-butylene oxide and alcohol-initiated random copolymers of 1,2-butylene oxide and propylene oxide into the lubricant formulation so as to obtain the lubricant of the present invention as described herein. The alcohol initiator is desirably selected from monols and diols for the 1,2-butylene oxide homopolymer and from monols for the copolymer.

EXAMPLES

Table 1 identifies a list of components from which lubricant formulations are prepared in each Example (Ex) of the present invention and each Comparative Example (Comp Ex) which follow.

TABLE 1

| Function | Component | Description |
|---|---|---|
| Hydrocarbon Base Oil | Group IV Base Oil | Group IV PAO with a typical kinematic viscosity of 8 centiStokes (cSt) at 100° C. For Example, SpectraSyn ™ 8 PAO Fluid (SpectraSyn is a trademark of Exxon Mobil Corporation). |
| Hydrocarbon Base Oil | Group III Base Oil | Group III mineral oil with a typical kinematic viscosity of 8 centiStokes at 100° C. For example, YUBASE ™ 8 brand base oil (YUBASE is a trademark of SK Lubricants Co.). |
| Hydrocarbon Base Oil | Group II Base Oil | Group II mineral oil with a typical kinematic viscosity of 6.5 centiStokes at 100° C. For example, 225N ™ brand base oil (225N is a trademark of Phillip 66). |
| OSP | OSP-18 | Dodecanol initiated random copolymer of propylene oxide and 1,2-butylene oxide (50/50 weight-ratio) with a typical kinematic viscosity at 40° C. of 18 centiStokes, at 100*C of 3.9 centiStokes and average molecular weight of 500 grams per mole. For example UCON ™ OSP-18 oil soluble polyalkylene glycol (UCON is a trademark of Union Carbide Corporation). |
| OSP | OSP-32 | Dodecanol initiated random copolymer of propylene oxide and 1,2-butylene oxide (50/50 weight-ratio) with a typical kinematic viscosity at 40° C. of 32 centiStokes, at 100° C. of 6.5 centiStokes and average molecular weight of 760 grams per mole. For example UCON ™ OSP-32 oil soluble polyalkylene glycol. |
| OSP | OSP-46 | Dodecanol initiated random copolymer of propylene oxide and 1,2-butylene oxide (50/50 weight-ratio) with a typical kinematic viscosity at 100° C. of 8.5 centiStokes. For example UCON ™ OSP-46 oil soluble polyalkylene glycol. |
| OSP | SYNALOX OA60 | Butanol initiated random homopolymer of 1,2-butylene oxide with a typical kinematic viscosity at 100° C. of 9 centiStokes. For example SYNALOX ™ OA60 oil soluble polyalkylene glycol. |

TABLE 1-continued

| Function | Component | Description |
|---|---|---|
| OSP | SYNALOX OD80 | Diol initiated random homopolymer of 1,2-butylene oxide with a typical kinematic viscosity at 100° C. of 11 centiStokes. For example SYNALOX ™ OD80 oil soluble polyalkylene glycol. |
| Sulfurized Olefin | SIB | Sulfurized isobutylene having approximately 45% sulfur, 40° C. viscosity of 50 centiStokes and 100° C. viscosity of 7 centiStokes with a specific gravity of 1.14. For example ELCO 217 sulfurized hydrocarbon from the Elco Corporation. |
| Sulfurized Olefin | Additin RC | Dialkylpolysulfide with approximately 40% sulfur, approximately 35% active sulfur, and 40° C. viscosity of 50 centiStokes. For Example, Additin ™ RC 2541 dialkylpolysulfide (Additin is a trademark of RheinChemie Additives). |
| Anti-wear additive | TPPT | Triphenyl phosphorothionate with 9.3% sulfur and 8.9% phosphorous. For example Irgalube ™ TPPT (Irgalube is a trademark of BASF SE Company). |

The synergistic effect of OSP in the lubricant formulations is demonstrated in the following Examples (Exs) and Comparative Examples (Comp Exs) using Group II, III and Group IV hydrocarbon base oils. The same effect is expected for Group I base oils. The different levels of refinement between Groups I, II and III hydrocarbon oils are not expected to affect the synergistic effect of the OSP.

All the samples of the present invention are prepared by taking a Group II, III and IV oil and adding the desired treat rates of a sulfur containing additive to form a solution. The oil soluble polyalkylene glycol is then added to the solution at a desired treat rate and the resulting mixture is then put on a hot stir plate at 55° C. to homogenize the sample.

Comparative Examples A-D

Hydrocarbon Base Oil with Sulfurized Olefin

Table 2 provides lubricant formulations consisting of hydrocarbon base oil and sulfurized olefin (SIB) with the SIB at two different concentrations in each base oil. The load value achieved in the extreme pressure performance characterization using the method stated previously above is also in Table 2. The results provide a reference for extreme pressure performance for lubricants containing only hydrocarbon base oil and sulfurized olefin with load values reported in kilogram (kg) and pounds (lb). For each formulation the concentration of components are listed in wt % relative to total formulation weight.

TABLE 2

| Component | Comp Ex A | Comp Ex B | Comp Ex C | Comp Ex D |
|---|---|---|---|---|
| Group III Base Oil | 98.5 | 95.0 | 0 | 0 |
| Group IV Base Oil | 0 | 0 | 98.5 | 95.0 |
| SIB | 1.5 | 5.0 | 1.5 | 5.0 |
| EP Load | 269 kg/593 lb | 359 kg/792 lb | 305 kg/672 lb | 380 kg/838 lb |

Examples 1-6

Group III Hydrocarbon Base Oil with Sulfurized Olefin and OSP

Table 3 provides lubricant formulations consisting of Group III hydrocarbon base oil with a combination of SIB and OSP at different loadings of OSP. For each formulation the concentration of components are listed in wt % relative to total formulation weight. The load value achieved in the extreme pressure performance characterization using the method stated previously above is also in Table 3 with resulting load values reported in kilograms (kg) and pounds (lb).

Comparing the results of Exs 1-6 with those of Comp Ex A and Comp Ex B reveals a dramatic increase in extreme pressure performance resulting from the combination of an alcohol initiated 1,2-butylene oxide/propylene oxide copolymer OSP and sulfurized olefin. Even using the lower level of sulfurized olefin (same as used in Comp Ex A), higher extreme pressure performance is achieved when the OSP is present relative to over three times the amount of sulfurized olefin without the OSP (see Comp Ex B). These results reveal the synergistic interaction between the OSP and sulfurized olefin that produces a higher extreme pressure performance

TABLE 3

| Component | Ex 1 | Ex 2 | Ex 3 | Ex 4 | Ex 5 | Ex 6 |
|---|---|---|---|---|---|---|
| Group III Base Oil | 93.5 | 83.5 | 68.5 | 93.5 | 83.5 | 68.5 |
| SIB | 1.5 | 1.5 | 1.5 | 1.5 | 1.5 | 1.5 |
| OSP 18 | 5.0 | 15 | 30 | 0 | 0 | 0 |
| OSP 46 | 0 | 0 | 0 | 5.0 | 15 | 30 |
| EP Load | 419 kg (924 lb) | 671 kg (1480 lb) | 853 kg (1880 lb) | 435 kg (960 lb) | 533 kg (1176 lb) | 794 kg (1750 lb) |

Examples 7-12

Group IV Hydrocarbon Base Oil with Sulfurized Olefin and OSP

Table 4 provides lubricant formulations consisting of Group IV hydrocarbon base oil with a combination of SIB and OSP at different loadings of OSP. For each formulation the concentration of components are listed in wt % relative to total formulation weight. The load value achieved in the extreme pressure performance characterization using the method stated previously above is also in Table 4 with resulting load values reported in kilograms (kg) and pounds (lb).

Comparing the results of Exs 7-12 with those of Comp Ex C and Comp Ex D reveals a dramatic increase in extreme pressure performance resulting from the combination of the OSP and sulfurized olefin. Even using the lower level of sulfurized olefin as used in Comp Ex C, higher extreme pressure performance is achieved when the OSP is present relative to over three times the amount of sulfurized olefin without the OSP (see Comp Ex D). These results reveal the synergistic interaction between the OSP and sulfurized olefin that produces a higher extreme pressure performance.

TABLE 4

| Component | Ex 7 | Ex 8 | Ex 9 | Ex 10 | Ex 11 | Ex 12 |
|---|---|---|---|---|---|---|
| Group IV Base Oil | 93.5 | 83.5 | 68.5 | 93.5 | 83.5 | 68.5 |
| SIB | 1.5 | 1.5 | 1.5 | 1.5 | 1.5 | 1.5 |
| OSP 18 | 5.0 | 15 | 30 | 0 | 0 | 0 |
| OSP 46 | 0 | 0 | 0 | 5.0 | 15 | 30 |
| EP Load | 431 kg (951 lb) | 645 kg (1422 lb) | 834 kg (1838 lb) | 410 kg (903 lb) | 596 kg (1313 lb) | 806 kg (1778 lb) |

Comparative Example E

Group IV Hydrocarbon Base Oil with Only OSP

Prepare a lubricant formulation (Comp Ex E) comprising 70 wt % Group IV Base Oil and 30 wt % OSP18 and subject to extreme pressure performance testing to determine whether the OSP alone is acting as an EP enhancing additive. The extreme pressure performance testing results in a load of 392 kg (864 lb). This loading of OSP18 in combination with 1.5 wt % sulfurized olefin demonstrated much higher loads in the extreme pressure property testing (see Ex 3, for example). Therefore, it is safe to conclude that the enhanced extreme pressure performance resulting from a combination of the OSP a sulfurized olefin is not solely due to either the OSP (see Comp Ex E) or solely due to the sulfurized olefin (see Comp Ex C).

Comparative Example F

OSP with Sulfurized Olefin

The synergistic enhancement of extreme pressure performance by a combination of alcohol initiated 1,2-butylene oxide polymers and sulfurized olefin is further confirmed by testing the extreme pressure performance of a combination (Comp Ex F) of 1.5 wt % SIB, 88.7 wt % OSP46 and 9.9 wt % OSP32—a combination of alcohol initiated 1,2-butylene oxide/propylene oxide copolymer OSPs and sulfurized olefin. The combination achieves a load value of 1035 kg (2282 lb) in the extreme pressure performance testing.

Comparative Example G and Example 13

Alternative Sulfurized Olefin

Table 5 contains formulations and extreme pressure property testing results for lubricant formulations containing Additin RC sulfurized olefin instead of SIB in formulations similar to those of Comp Ex C and Ex 8, but with Additin RC instead of SIB. The results in Table 5 affirms the synergistic effect of increasing extreme pressure performance between the OSP and sulfurized olefins.

TABLE 5

| Component | Comp Ex G | Ex 13 |
|---|---|---|
| Group IV Base Oil | 98.5 | 83.5 |
| Additin RC | 1.5 | 1.5 |
| OSP 18 | 0 | 15 |
| EP Load | 398 kg (878 lb) | 815 kg (1797 lb) |

Comparative Examples H and I

Alternative AW/EP Additive without Synergy

Table 6 contains formulations and extreme pressure property testing results for lubricant formulations containing TPPT instead of a sulfurized olefin—one formulation with the OSP and one without. Inclusion of OSP with TPPT does not result in enhanced EP performance, further confirming the unique synergy demonstrated by a combination of the OSP and sulfurized polyolefins.

TABLE 6

| Component | Comp Ex H | Comp Ex I |
|---|---|---|
| Group IV Base Oil | 98.5 | 83.5 |
| TPPT | 1.5 | 1.5 |
| OSP 18 | 0 | 15 |
| EP Load | 512 kg (1128 lb) | 465 kg (1026 lb) |

Examples 14-15

Group III Hydrocarbon Base Oil with Sulfurized Olefin and Different OSPs

Table 7 describes lubricant formulations consisting of a Group III hydrocarbon base oil with a combination of SIB and other types of OSP such as SYNALOX OA60 and SYNALOX OD80. Comparing the results of Ex 14 and Ex 15 with those of Comp Ex A and Comp Ex B reveals a dramatic increase in extreme pressure performance resulting from the combination of an alcohol/diol initiated 1,2-butylene oxide homopolymer OSP and sulfurized olefin. Even when using a lower level of sulfurized olefin (e.g., the same level as used in Comp Ex A), a higher extreme pressure performance is achieved when the OSP is present relative to over three times the amount of sulfurized olefin without the OSP (see Comp Ex B). These results reveal the synergistic interaction between the other types of OSP and sulfurized olefin that produces a higher extreme pressure performance.

TABLE 7

| Component | Ex 14 | Ex 15 |
|---|---|---|
| Group III Base Oil | 98.5 | 83.5 |
| SIB | 1.5 | 1.5 |
| SYNALOX OA60 | 15 | |
| SYNALOX OD80 | | 15 |
| EP Load | 859 kg (1890 lb) | 606 kg (1334 lb) |

Comparative Examples J and K and Examples 16-18

Group II Hydrocarbon Base Oil with Sulfurized Olefin and OSP

Table 8 describes lubricant formulations consisting of a Group II hydrocarbon base oil with a combination of SIB and different types of OSP at 15 wt %. For each formulation, the concentration of components are listed in wt % relative to total formulation weight. The load value achieved in the extreme pressure performance characterization using the method stated previously above is also in Table 3 with resulting load values reported in kilograms (kg) and in pounds (lb).

Comparing the results of Exs 16-18 with those of Comp Ex J and Comp Ex K reveals a dramatic increase in extreme pressure performance resulting from the combination of different types of OSP such as alcohol initiated 1,2-butylene oxide/propylene oxide copolymer, alcohol and diol initiated homopolymer of 1,2-butylene oxide and sulfurized olefin. Even when using a lower level of sulfurized olefin (e.g., the same level as used in Comp Ex J), a higher extreme pressure performance is achieved when the OSP is present relative to over three times the amount of sulfurized olefin without the OSP (see Comp Ex K). These results reveal the synergistic interaction between the OSP and sulfurized olefin that produces a higher extreme pressure performance.

TABLE 8

| Components | Comp Ex J Group II + SIB Wt % | Comp Ex K Group II + SIB (3X) Wt % | Ex 16 Group II + SIB + 15% OSP Wt % | Ex 17 Group II + SIB + 15% OA60 Wt % | Ex 18 Group II + SIB + 15% OD80 Wt % |
|---|---|---|---|---|---|
| 225N (Group II MO) | 98.5 | 95.0 | 83.5 | 83.5 | 83.5 |
| ELCO 217 (SIB) | 1.5 | 5.0 | 1.5 | 1.5 | 1.5 |
| OSP18 | | | 15.0 | | |
| SYNALOX OA60 | — | | | 15.0 | |
| SYNALOX OD80 | | | | | 15.0 |
| Total | 100.0 | 100.0 | 100.0 | 100.0 | 100.0 |
| Test and Results | | | | | |
| Extreme Pressure ASTM D 3233 A Ok loads (lb) | <500 | <500 | 1085 | 970 | 1488 |

What is claimed is:

1. A lubricant formulation comprising:

a. at least 50 weight-percent of a hydrocarbon base oil;

b. five weight-percent or more and less than 50 weight-percent of an oil soluble polyalkylene glycol selected from a group consisting of monol, diol and triol initiated 1,2-butylene oxide homopolymers and monol initiated copolymers of 1,2-butylene oxide and propylene oxide; and c. 0.1 weight-percent or more and five weight-percent or less of a sulfurized olefin, where weight-percent is based on total lubricant formulation weight.

2. The lubricant of claim 1, wherein the oil soluble polyalkylene glycol is a dodecanol-initiated random copolymer of 1,2-butylene oxide and propylene oxide.

3. The lubricant of claim 1, wherein the oil soluble polyalkylene glycol is a butanol initiated homopolymer of 1,2-butylene oxide.

4. The lubricant of claim 1, wherein the oil soluble polyalkylene glycol is a diol initiated homopolymer of 1,2-butylene oxide.

5. The lubricant formulation of claim 1, wherein the concentration of polyalkylene glycol is five weight-percent or more and 30 weight-percent or less with weight-percent based on total weight of the lubricant formulation.

6. The lubricant formulation of claim 1, further characterized by the sulfurized olefin being sulfurized isobutylene.

7. The lubricant formulation of claim 1, further characterized by the hydrocarbon base oil being selected from Group II, Group III and Group IV base oils.

8. The lubricant formulation of claim 1, further characterized by being free of sulfurized fatty oil.

9. The lubricant formulation of claim 1, further characterized by comprising less than 75 weight-percent polyalphaolefin based on total formulation weight.

10. A method of increasing the extreme pressure performance of a lubricant formulation containing hydrocarbon base oil and sulfurized olefin, the method comprising adding to the lubricant formulation an oil soluble polyalkylene glycol selected from a group consisting of monol, diol and triol initiated 1,2-butylene oxide homopolymers and monol initiated random copolymers of 1,2-butylene oxide and propylene oxide so as to obtain the lubricant formulation of claim 1.

11. The method of claim 10, wherein the monol is dodecanol for the monol initiated random copolymers of 1,2-butylene oxide and propylene oxide.

* * * * *